US005176610A

United States Patent [19]

Gietman, Jr.

[11] Patent Number: 5,176,610

[45] Date of Patent: Jan. 5, 1993

[54] FLY-KNIFE DAMPENING SYSTEM

[75] Inventor: Peter J. Gietman, Jr., Combined Locks, Wis.

[73] Assignee: Custom Machinery Design, Inc., Appleton, Wis.

[21] Appl. No.: 699,163

[22] Filed: May 13, 1991

[51] Int. Cl.[5] ..... B31B 23/14

[52] U.S. Cl. ..... 493/194; 493/197; 493/233; 83/337; 83/349; 83/564

[58] Field of Search ..... 83/349, 331, 337, 343, 83/344, 345, 346, 348, 564, 673, 674, 678, 695; 493/194, 195, 196, 197, 199, 200, 201, 202, 233; 242/56 R

[56] References Cited

U.S. PATENT DOCUMENTS

| | | | |
|---|---|---|---|
| 1,306,009 | 6/1919 | Hartman | 83/337 |
| 2,445,174 | 7/1948 | Hanhewald et al. | 83/337 |
| 2,764,238 | 9/1956 | Rusinoff et al. | 83/343 X |
| 2,850,092 | 9/1958 | Teplitz | 83/344 X |
| 3,222,966 | 12/1965 | Tornberg et al. | 83/98 |
| 4,159,661 | 7/1979 | Russell et al. | 83/349 X |
| 4,364,293 | 12/1982 | Hirsch | 83/674 |
| 4,553,461 | 11/1985 | Belongia | 83/344 |
| 4,642,084 | 2/1987 | Gietman, Jr. | 493/190 |
| 4,695,005 | 9/1987 | Gietman, Jr. | 242/56 R |

FOREIGN PATENT DOCUMENTS 565204 11/1932 Fed. Rep. of Germany ..... 83/337

*Primary Examiner*—Douglas D. Watts
*Assistant Examiner*—Eugenia A. Jones
*Attorney, Agent, or Firm*—Foley & Lardner

[57] ABSTRACT

A system for dampening deflections which occur in an elongate rotating fly-knife includes camming elements along the length of the beam carrying the fly-knife. A second beam spaced from the knife is also mounted for rotation and includes spaced apart camming elements adapted to rotate and contact the fly-knife camming elements at that point during the rotational cycle when the fly-knife will cut and/or perforate the material with which the apparatus of the present invention is employed. In one preferred embodiment of the invention, the system is used to perforate, slit or cut plastic film, e.g., in the manufacture of bags. In another preferred embodiment of the invention, the system is used with a coversheet winding machine. The rotating beams of the invention are preferably driven by a single motor to maintain registration of the knife camming elements with the support beam camming elements.

13 Claims, 6 Drawing Sheets 51
18
54
54
51
16
51
37
59
20
61
34
28
14
56
57
60
22
25
30
43
30
45
26
36
58
39
44
62
12
40
MOTOR
67
55
35
32
42
65
10
66
63
64
24

FLY-KNIFE DAMPENING SYSTEM

TECHNICAL FIELD

The present invention relates generally to the art of dampening bounce and vibration and to maintaining a straight cutting edge in rotating knife elements, such as those used in the manufacture of plastic bags, dropcloths or other coversheet materials from polyethylene film. The invention may also be employed with other rotating cutters, such as die cutting equipment.

BACKGROUND OF THE INVENTION

In several parts of this specification reference is made to equipment useful for making plastic bags. These products are typically made on equipment which processes a flattened tube of polymeric material, such as polyethylene film, by steps such as sealing, perforating, cutting, etc. With the advent of very thin, high density plastic films and the higher speeds available in modern equipment, it has become important to engineer the components which contact the film to increasingly stringent tolerances.

In other parts of the specification, reference is made to equipment useful for making dropcloths or other coversheet materials. These products are typically made on equipment which processes a continuous lay-flat strip of plastic, again such as polyethylene, by steps such as slitting, folding or gusseting, and winding such material into core or coreless rolls. In the case of thick film which is rapidly wound, it is important to ensure the accuracy of the cut, which tends to bog down as film thicknesses are increased.

For example, stringent tolerances are necessary to maintain the rotary fly-knife in a straight condition as it contacts the bed knife in machines which employ such techniques for cutting and/or perforating bags or coversheet materials. No matter how carefully the knife blades, their support beams and bearing and drive components are manufactured, however, bounce and deflection can and do take place at the high rotation speeds encountered (e.g., 300 and higher feet per minute, circumferential speed). With film thickness of 1 mil or lower, and with even the most careful attention to manufacturing detail, problems are regularly encountered which prevent getting a good cut against the bed knife. Obviously, if for any reason the knife is not precisely set at various locations along its length, either the knife will be damaged by considerable striking against the bed knife or will fail to cut entirely through the film being processed. Moreover, the condition of the knife may change with speed, temperature and other factors. When the knife is not properly set, repair, adjustment or replacement is necessary, leading to the costs associated therewith, as well as machine and personnel downtime.

The types of problems just mentioned also occur, with varying degrees, in other types of machinery which involve the use of elongate rolls. Such applications include, but are not at all limited to, paper manufacturing, paper converting (e.g., die cutting for folding cartons or corrugated containers), printing, other applications including film handling (foil, paper, plastic and the like), to name a few. Accordingly, throughout this specification, wherever references are made to the rotating fly-knife in a rotary bag making machine, it should be understood that each of the other types of devices referred to above and others could also benefit from the teachings hereof.

The assignee of the present invention has been instrumental in the development of high speed rotary bag making and winder equipment. A machine which will benefit from the present invention is illustrated in Gietman, U.S. Pat. No. 4,642,084, issued Feb. 10, 1987 for "Plastic Bag Making Machine". The particular machine shown therein will be helpful for describing one environment in which the present invention has great applicability. The bag machine includes a rotary sealing drum having one or more sealing bars located around the drum periphery. A blanket is mounted on a plurality of rollers located about the drum to provide circumferential contact between the drum and blanket. Drum motor means are coupled to the blanket rollers to drive the drum through the frictional contact between drum and blanket.

An incoming, flattened tube of plastic film, e.g., polyethylene, is fed into the drum-blanket nip and through the circumferential area of contact where it is contacted by a sealing bar to create a transverse seal across the film. In the device illustrated in the patent, the sealed film stock exits the drum area and is folded over a plurality of folding boards to reduce the width of the film to approximately ¼ its original width (greater or lesser folding, of course, can be accomplished at this stage). Following folding, the film stock is fed by a plurality of feed rollers into the nip of a rotating fly-knife and a stationary bed knife to perform a cutting and/or perforating operation, such that the film stock at this point includes a continuous line of connected bags which can be separated one from another by tearing across the perforation line. Downstream of the knife system the bags can be separated and folded, or they can be wound into core or coreless rolls, procedures which in and of themselves do not pertain to the present invention.

One aspect of the earlier Gietman invention which is of note here is the driving system which results from the original motor-blanket roller pulling drive. Since all blanket rollers would be driven by the blanket at the speed determined by the motor, thus establishing the drum speed, and thus defining the line speed for the film being procured, it is shown that a belt and pulley system coupled to a pulley in the motor is coupled to a gear box, in turn coupled by another belt and pulley system to a variator device. The gear box permits downstream operations to be varied in integral adjustments, depending on the number of sealing bars activated on the drum. The variator permits fine tuning to ensure that the cut/slit operation and sealing operations are occurring at the proper locations. It should also be mentioned that the drum diameter in the aforementioned device can be varied to form a widely differing variety of bag lengths.

Coupled between the variator and the fly-knife of the earlier system is yet another belt and pulley drive system which rotates the fly-knife at the desired speed. With the difficulties in maintaining straightness, and the deflection problems which are being experienced with wider machines and with increasing speed (noted above), improvements are needed in this area of the machine. Widths of up to 70 inches are now encountered in this type of equipment and films as thin as 0.003" are now being used. As speeds vary, the deflection problems vary, thus resulting in adjustment problems, no matter how carefully the engineering is performed.

The assignee of the present invention has also been instrumental in the development of coreless winders for strips of pliable materials. Another machine which benefits from the present invention is illustrated in Gietman Jr., U.S. Pat. No. 4,695,005, issued Sep. 22, 1987 for "Coreless Winder for Strips of Pliable Material." The machine disclosed therein will be helpful for describing another environment in which the present invention has applicability.

The winding apparatus disclosed therein includes a dancer system for "slaving" the winder to the sheet material feed device (e.g., an unwind station or a film extruder). The sheet material enters a pull roll section, having a specified roll diameter, which cooperates with a stationary bed knife and a rotating fly knife to permit accurate separation of the feed material into strips having the desired length. A first conveyor section follows the cut-off section and leads to a pivoting conveyor section, the latter being adapted to selectively direct the sheet material to one of a plurality of winding assemblies.

Each winding assembly preferably features dual rods, the rods being spaced apart to receive the leading edge of the sheet material to be wound. The winding assemblies also include systems for causing rotation of the rods to effect the winding of the sheet material and a mechanism for collapsing one of the two rods toward the other, whereby the inner wraps of the sheet material are loosened to permit easy removal of the roll. A push-off palm may be employed to assist in roll removal.

Widths of up to 12–15 feet are now encountered with this type of equipment and films as thick as about 4 mils are used. As speeds increase, maintaining the accuracy of the cut becomes increasingly difficult.

Problems similar to these described above have been noted in several other devices for processing strips of pliable material. See, for example, Belongia, U.S. Pat. No. 4,553,461, issued Nov. 19, 1985 for "Rotary Web Processing Apparatus". In that device, preloaded rollers tend to control roller bounce and maintain constant the gap between rollers. In the disclosed embodiment, such pre-load rollers are located at either end of a roller.

Hirsch, U.S. Pat. No. 4,364,293, issued Dec. 21, 1982 for "Rotary Knife Holder With Means For Dampening Its Natural Frequency Oscillations", employs a cylindrical mass whose ends are surrounded by elastic annuli installed in a sleeve fixedly mounted in the axial bore of the carrier. The frequency of the system is attuned to the natural frequency of the carrier and is installed midway between the ends of the carrier.

Tornberg, et al., U.S. Pat. No. 3,222,966, issued Dec. 14, 1965 for "High Speed Web Punching Device", use a drag roller urged into position by other rollers bearing against it to force the drag roller into position. The tensioning wheels used therein are in constant contact with the roller and are spaced along its length.

Teplitz, in U.S. Pat. No. 2,850,092, issued Sep. 2, 1958 for "Flying Shear", uses counter weights built into knife-carrying rolls to help maintain balance.

None of the aforementioned patents describe or teach a system for maintaining precise alignment along the length of a rotary member, such as a rotating fly-knife of the type described in the beginning portion of this section. A system which would do so would represent a significant advance in the art and address a need long felt by those skilled in the art.

SUMMARY OF THE INVENTION

The present invention involves a system for maintaining a rotating member in proper adjustment and is useful in a variety of applications, such as for use with a rotating fly-knife of the type used in rotary bag making machines or coversheet winding machines.

The present invention features a camming system which comes into play during that portion of the rotary cycle of the device (such as the fly-knife) when proper alignment is most important. The present invention, in its preferred embodiment, also features a camming system on both the rotating device and a parallel, but spaced apart, rotating beam, the cams being arranged to contact one another during the rotary cycle.

The present invention additionally features a system which can be widely adapted to a variety of end uses or which can be retrofit to improve the performance of existing equipment. In this manner, the present invention provides a technique which may be employed to increase machine efficiency and precision, while reducing maintenance costs, reducing the frequency of machine downtime and which, in the case of fly-knife devices, can materially reduce the frequency of knife replacement and/or knife sharpening.

How the present invention provides these benefits will become apparent shortly as the preferred embodiment thereof is described in connection with the figures. Generally, however, the benefits are provided by mounting a rotating member, such as a fly-knife of a rotary bag machine, in a bearing and drive system which allows a knife-carrying beam to be rotated about a longitudinal axis. Camming elements are arranged at a spaced apart location along the beam. The camming elements provide a camming surface about their respective exterior portions and are preferably co-axially mounted on the beam.

Another elongate beam is mounted parallel to, but spaced apart from, the first beam in a bearing support which allows the second beam (shaft) to rotate about its axis. A drive system is employed to ensure that the beams are rotating at the same speed. A plurality of camming elements are also mounted on the second beam and are spaced from one another in a manner such that each camming element of the second beam is aligned with a corresponding element on the first beam. Moreover, the elements on each beam are arranged so that the cam surfaces of the various elements contact one another during that portion of the fly-knife rotation where it performs its cutting and/or perforating operation against a bed knife. Thus, at that particular point in the rotation, alignment is maintained by the urging of the camming sections toward one another, thereby minimizing misadjustment, bounce, deflection and other factors caused by high speed rotation of such elements.

Other ways in which the benefits of the present invention can be embodied and modified by those skilled in the art for a variety of applications will be discussed in the following sections of this specification.

Figure 1:
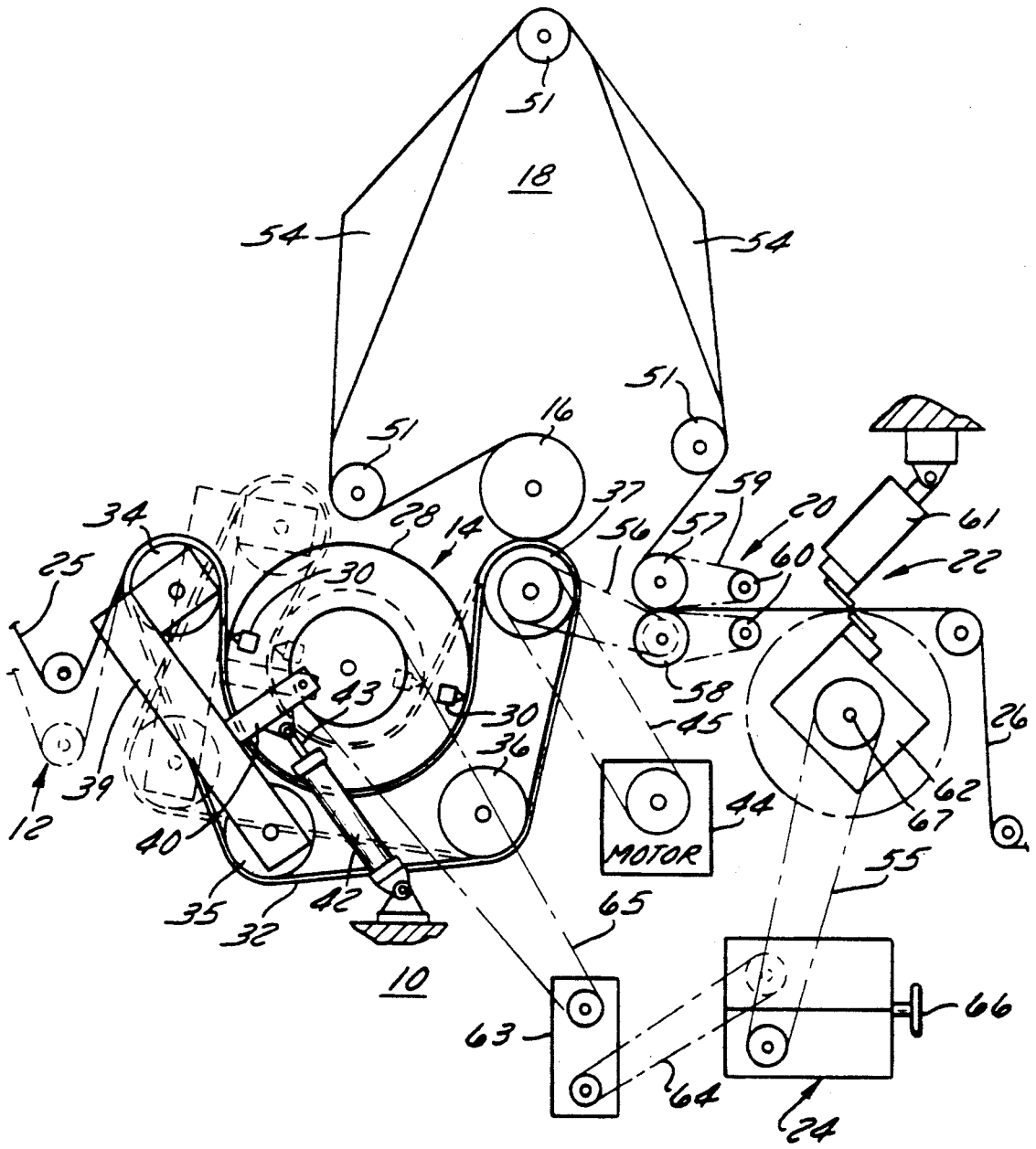
FIG. 1 is a schematic illustration of a bag making machine with which the dampening system of the present invention may be employed.

In the various figures, like reference numerals are used to represent like components. Furthermore, scale is not employed in the drawings and some components of typical bag making machines have been eliminated for purposes of showing with greater clarity those components which pertain to the present invention.

DESCRIPTION OF THE PREFERRED EMBODIMENTS

The present invention will be described in this section of the specification as part of a plastic bag making machine or a coversheet winding machine, but it should be appreciated that the novel features of the invention make the invention particularly suitable for many other types of machines such as, but not limited to, machines used for slicing, die cutting, printing or otherwise contacting films, foils, laminates and the like, where rollers spin about their axes in such a way that increased control of roller adjustment is or would be desirable. Obviously, the invention is even more desirable in those machines or systems where very close tolerances are desired and/or where speeds are so high that bounce and misalignment problems result.

Before proceeding to a more detailed description of the preferred embodiment, it will be helpful to briefly acquaint the reader with the basic elements of one type of machine with which the present invention may be used. For this purpose, reference is first made to the schematic diagram of FIG. 1. In FIG. 1, a bag making machine 10 includes certain major elements: a dancer assembly 12, a sealing drum and blanket assembly 14, a chill roll 16, a folding board system 18, a pull roll system 20, a cutting and/or perforation system 22, and a variator assembly 24. Each system will be described in more detail hereafter, and to help explain the schematic, a flattened plastic film tube is shown entering the device at 25 and a series of connected and perforated bags is shown leaving the device at 26.

The dancer assembly 12 is shown in FIG. 1 in only general form, as dancers are well-known in the art. It functions to properly time the bag machine speed with the upstream equipment (e.g., the extrusion equipment). In practice, the dancer is a free running roll, the axis of which is vertically movable on a chain (not shown). The chain is coupled to a sensing mechanism so that the speed of the bag machines can be slaved to the speed of the extruder. If bag machine 10 is used out of line, the dancer roll may still be employed, but it does not regulate the bag machine speed. In this case, the bag machine speed will be set manually.

The sealing drum and blanket assembly 14 consists of a cylindrical drum 28, which is capable of being varied in diameter as is illustrated in FIG. 1 by the dotted line showing drum 28 having a reduced diameter. A pair of sealing bars 30 are also shown in FIG. 1 and, when actuated, cross seal the flattened film tube to form bags.

A blanket 32 is mounted on rollers 34, 35, 36 and 37 for surrounding a portion of drum 28 in such a way that the film passes between blanket 32 and drum 28 while the seal is being formed. Rollers 34 and 35 are mounted to an elongate frame 39 which is pivotable between the full and dotted line positions shown in FIG. 1. Frame 39 includes a perpendicular plate 40 near its midsection, the latter being coupled to an air cylinder 42 having an extensible piston 43. It will be appreciated that extension of piston 43 causes rollers 34 and 35 to move to the dotted line position when the drum diameter decreases, thereby maintaining tension of blanket 32 against drum 28. Roller 37 is driven from a motor 44 by belt 45 to drive blanket 32, and in turn blanket 32 rotates drum 28 due to the tension which exists between these components.

Once the cross-sealed continuous film (bags) leave the drum-blanket assembly, the continuous film passes over a free-running chill roll 16 mounted near the exit nip of blanket 32 and drum 28. While not shown in FIG. 1, chill roll 16 may be provided with an inlet and outlet for a cooling medium (such as cold water, chilled air, etc.). Chill roll 16 quickly cools the seal made by sealing bars 30.

The next component of bag machine 10 which the continuous film encounters is folding board system 18 which is of conventional design and which will not be described in detail. Folding board system 18 includes a plurality of idler rollers 51 and folding boards 54. As is known to the art, the flat tube of film is folded longitudinally on the boards 54 to reduce its width to the desired final width. In commercial practice, the width may be reduced from, for example, about 34 inches to about 8½ inches on two folding boards for consumer type packages.

The next feature of bag machine 10 is pull roll system 20 which includes a pair of pull rolls 57 and 58 which are arranged for pulling the traveling film over the folding boards. Pull rolls 57 and 58 have a constant drive speed (i.e., roll 58 is coupled to roller 37 by belt 56). Pull rolls 57 and 58 also include a plurality of ropes 59 and rope return rollers 60 which ensure that the film passes through this section without being caught in or wrapped around the rolls.

Following pull roll system 20 is a cutting system 22 which is constructed and arranged for cutting and/or perforating the folded film adjacent to the cross-seal to complete the bag manufacturing process. Cutting section 22 includes a bed knife 61 and a rotating fly-knife 62, the latter being driven by a belt 55 from the variator assembly 24. It should be understood that the fly-knife 62 rotates about fly-knife shaft 67 in synchronization with drum 28.

In a most preferred embodiment, fly-knife 62 has a unique construction and function, such as set forth in the above-referenced Gietman, U.S. Pat. No. 4,642,084. In particular, fly-knife 62 preferably includes a blade having a cutting section ana a perforation section on each side thereof, as will be described in greater detail below. The function of the construction is to partially cut the layers of plastic film of the folded traveling bags across a portion of their length, and to perforate those layers in the areas where there are no cuts such that the bags stay connected to one another while packaging is being completed but may be thereafter easily separated.

The variator assembly 24 which, through belt 25, drives fly-knife 62, ensures a proper skirt length between the cut-perforation and the bag seal. Variator assembly 24 is driven from a gear box 63 by a belt 64. Gear box 63 is driven by drum 28 through the belt 65. Variator assembly 24 also includes a hand wheel 66 which is used to vary the phase of fly-knife 62 with respect to drum rotation. It should be recognized at this point, however, that the variator may be adjusted while the bag making machine 10 is in operation and the synchronization and registration of the seal and the cut do not, in and of themselves, form part of the present invention.

Figure 2:
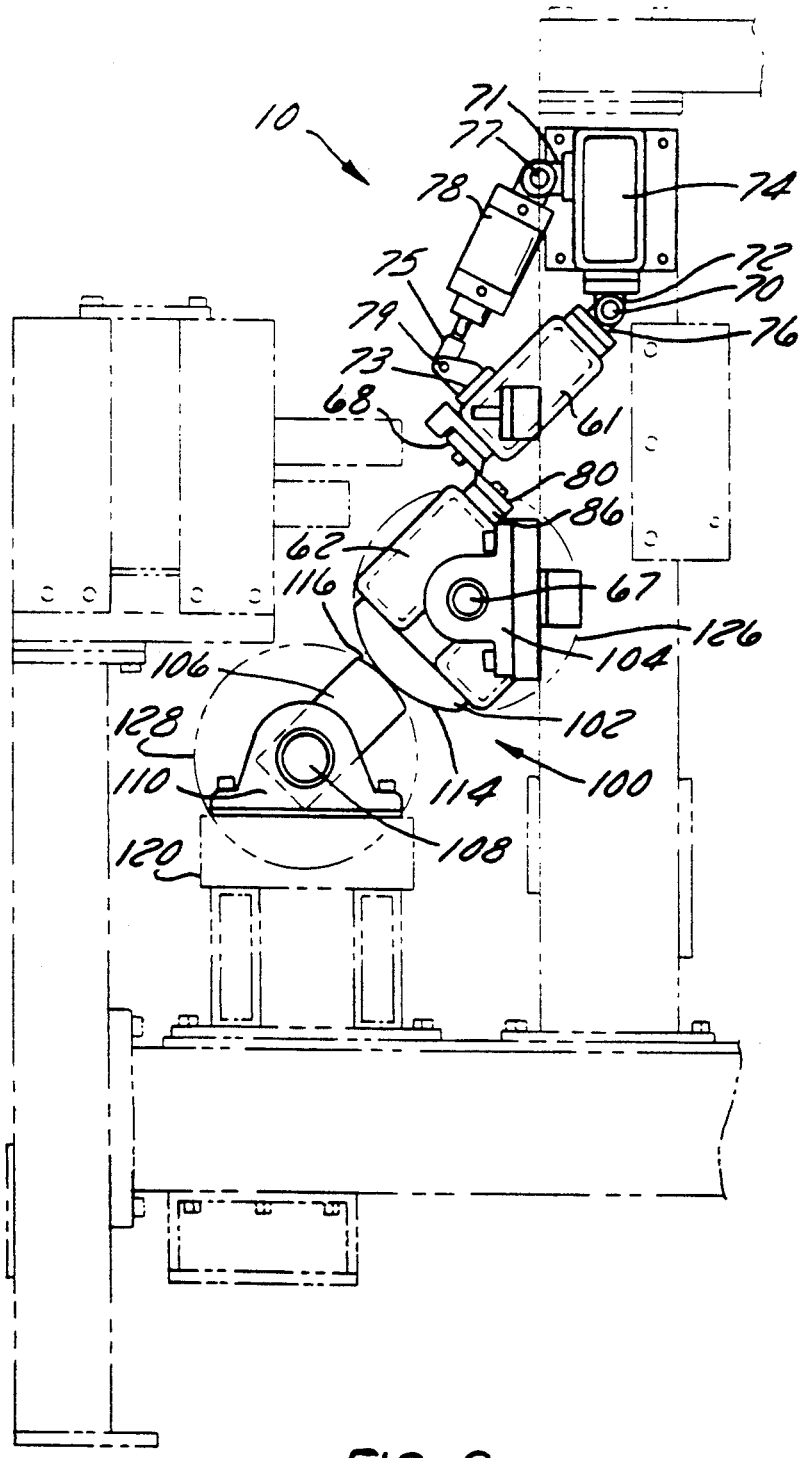
FIG. 2 is an end view of the fly and bed knife arrangement according to the preferred embodiment of the present invention.

In a preferred embodiment, as best seen in FIG. 2, bed knife 61 includes a bed knife blade 68. Bed knife blade 68 may be provided with any cut-perforation pattern, but typically includes only a cutting portion. As seen best in FIG. 3, a bed knife mounting surface 82 extends across bed knife 61 and contains a plurality of holes 84 for attachment of bed knife blade 64 thereto by bolts 90. Bed knife 61 is pivotally mounted about elongate bed knife pivot beam (shaft) 70. An upper pivot bracket 72 is rigidly secured to a mounting bracket 74 on the frame of bag machine 10, while a lower pivot bracket 76 is affixed to bed knife 61. Shaft 70 passes through upper pivot bracket 72 and lower pivot bracket 76 such that bed knife 61 will not move radially but can pivot about shaft 70.

A fly-knife blade 80 is fastened to the outermost end of rotating fly-knife 62. As shown in both FIGS. 2 and 3, fly-knife blade 80 cooperates with bed knife blade 68 to appropriately cut and/or perforate the bags when fly-knife blade 80 passes bed knife blade 68, as is explained in Gietman '084. A mounting surface 86, similar to mounting surface 82, is provided on fly-knife 62 for mounting fly-knife blade 80. Surface 86 contains a plurality of holes 88. Holes 84, like holes 88, suitably receive bolts 90 which securely attach fly-knife blade 80 to fly-knife 62.

As shown, blades 68 and 80 are shorter than support areas 82 and 86, which allows for accurate placement of the blades anywhere along mounting surfaces 82 and 86. In a preferred embodiment of the invention, blades 68 and 80 are mounted adjacent one of the ends of support areas 82 and 86.

Figure 3:
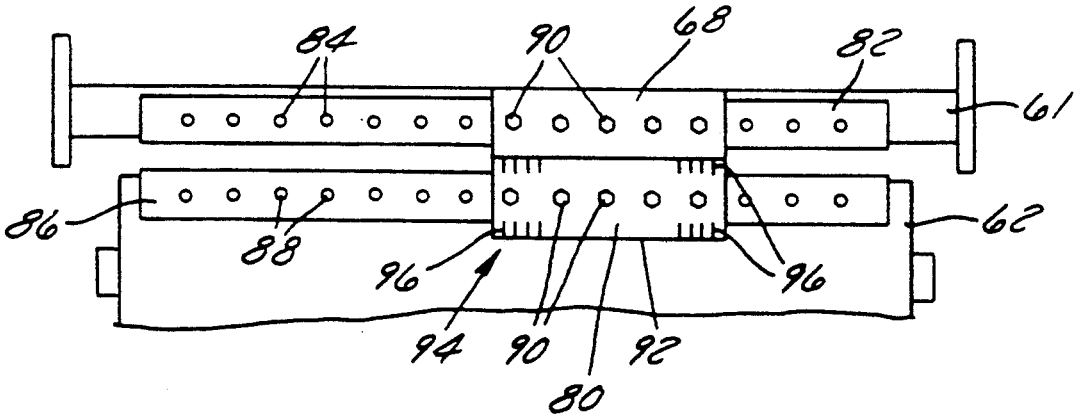
FIG. 3 is a more detailed front elevation view of the fly and bed knives used in the machine of FIG. 1.

With continued reference to FIG. 3, fly-knife blade 80 is provided with at least one cutting section 92 and at least one perforating section 94 on each end thereof. Perforating section 94 is formed by a plurality of grooves 96. In a preferred embodiment of the invention, fly-knife blade 80 is provided with one cutting section 92 interposed between two perforating sections 94 on each end thereof. Fly-knife blade 80 may, however, be provided with other cut-perforation patterns which are known to or hereafter devised by those of ordinary skill in the art.

A plurality of air cylinders 78 are pivotally attached to bed knife 61 and mounting bracket 74 such that bed knife 61 can automatically be pivoted up or down. When air cylinders 78 are activated, they pull against the upper side of bed knife 61, lifting bed knife 61 and bed knife blade 68 away from fly-knife 62. By lifting bed knife 61, a gap is formed between rotating fly-knife 62 and bed knife 61 to provide clearance when initially threading the bags through pull roll system 20.

Once the bags are threaded through pull roll system 20, bed knife 61 can be returned to its cutting position by activating air cylinders 78 in a reverse direction. Reversing air cylinders 78 lower bed knife 61 to a position where fly-knife 62 can pass in close proximity to bed knife 61.

To provide accurate positioning and movement of bed knife 61, various numbers of air cylinders 78 can be provided, each with associated upper pivot bracket 71, lower pivot bracket 73, clevis bracket 75, and pivot shafts 77 and 79. In a preferred embodiment, as best seen in FIG. 4, a series of air cylinders 78 pivot bed knife 61 about axially aligned shafts 70 extending through upper pivot brackets 71 and lower pivot brackets 73.

Figure 4:
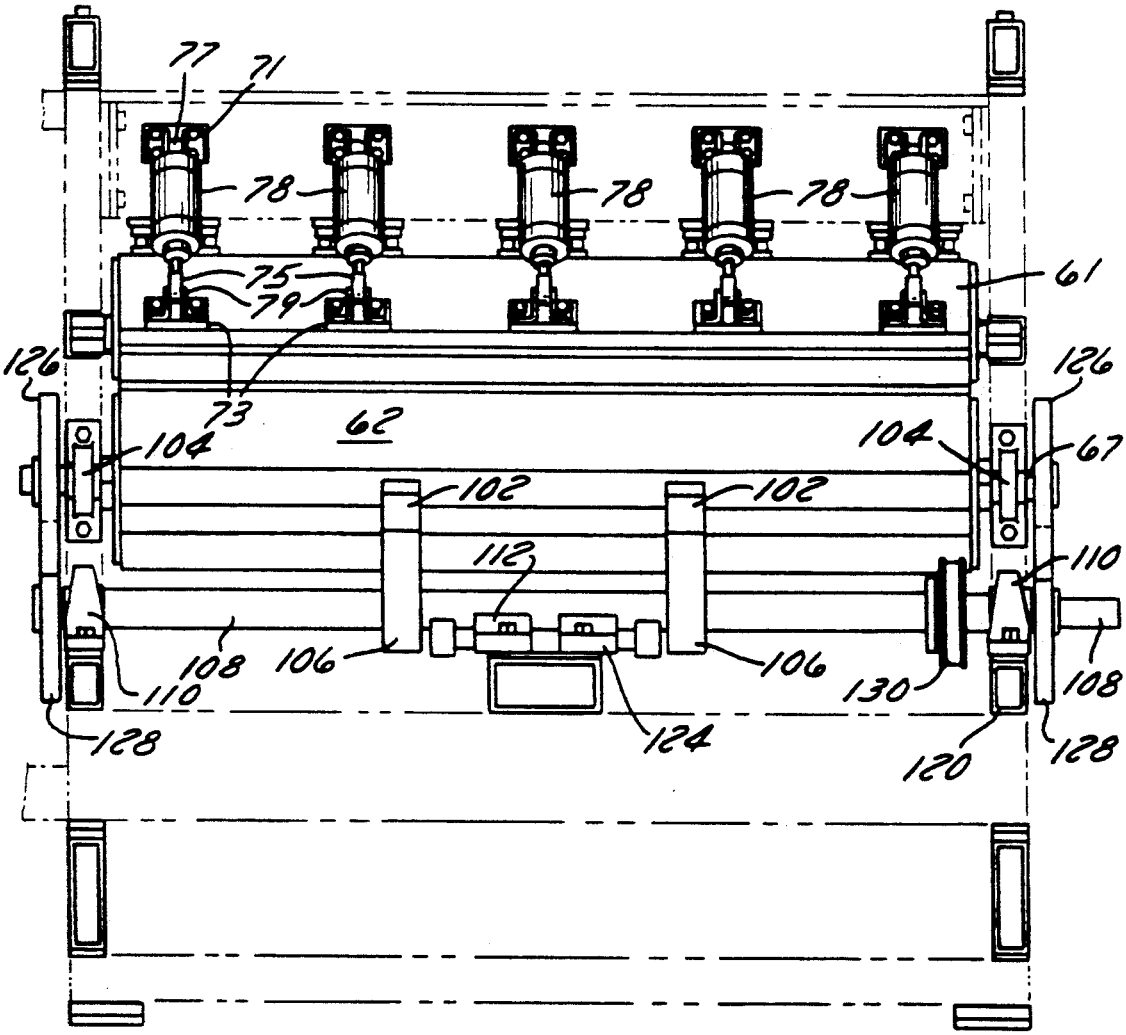
FIG. 4 is an expanded front view showing the cam and support bearing arrangement used in the preferred embodiment of the present invention.

With reference to FIGS. 2 and 4, fly-knife 62 is supported by a fly-knife dampening system 100 which prevents fly-knife 62 from bending and vibrating and thereby improves the quality of the cut. Fly-knife dampening system 100 features a camming system which comes into play during that portion of the rotary cycle of fly-knife 62, when fly-knife 62 operatively engages bed knife 61. Preferably, dampening system 100 comprises respective fly-knife cams 102, respective fly-knife bearings 104, respective support cams 106, a support cam shaft 108, respective support cam shaft bearings 110, and central cam shaft bearings 112.

Fly-knife cams 102 are affixed to rotating fly-knife 62 opposite the fly-knife blade 80. Each fly-knife cam 102 has a cam edge 114. Preferably, cam edge 114 comprises an arcuate and grounded edge. Support cams 106 are affixed to support cam beam 108. Support cam beam (shaft) 108 is generally parallel and spaced apart from fly-knife 62. Support cams 106 are keyed to shaft 108 such that cams 106 rotate in unison with shaft 108. Support cam shaft bearings 110 are secured to a portion 120 of the frame of bag making machine 10.

Each support cam 106 also includes a cam edge 116 suitably configured to operatively contact cam edge 114. In a preferred embodiment of the invention, cams 106 comprise an arcuate and grounded edge, having cam edges 116 disposed for rolling engagement with cam edges 114 of fly-knife cams 102. Preferably, as best seen in FIG. 4, there are two (2) or any number of fly-knife cams and two (2) or any number of support cams which roll against each other, although various numbers of cams could be used, providing they provide support for rotating fly-knife 62.

Support cam shaft 108 is further supported by central cam shaft bearings 112. With reference to FIG. 4, central cam shaft bearings 112 are mounted in a bearing mount 124. Bearings 112 roll against shaft 108 and prevent flexing in shaft 108. Cam bearing mount 124 is rigidly secured to the frame of bag making machine 10 in any conventional manner. Typically, central cam shaft bearings 112 are disposed between two or more support cams 106.

In general, camming elements 102 and 106 are formed from metal plates having portions machined therefrom to provide the camming surfaces 114 and 116. Camming elements 102 and 106 are preferably co-axially mounted and spaced apart on fly-knife beam 62 and support cam beam 108, such that the camming surfaces 114 and 116 contact one another during that portion of the rotation of fly-knife 62 where fly-knife 62 performs its cutting and/or perforating operation against bed knife 61.

From this description it will be apparent that when support cams 106 rotate counter-clockwise with support cam shaft 108, fly-knife 62 and fly-knife cams 102 rotate clockwise, with the rotations being timed such that support cams 106 and fly-knife cams 102 meet and roll against each other as fly-knife blade 80 passes bed knife blade 68. Rotating fly-knife 62 is thus supported and does not bow as the cut and/or perforation pattern is made in the traveling film. A consistent quality cut-perforation pattern is thus made.

A drive system is preferably employed to ensure that fly-knife beam 62 and support cam beam 108 are rotating at the same speed such that camming elements 102 and 106 affixed thereto likewise are rotating at the same speed. The timing of support cams 106 and fly-knife cams 102 is preferably controlled by respective gears 126 located at the ends of fly-knife shaft 67, and respective gears 128 located at the ends of support cam shaft 108. Each gear is of the same diameter and tooth count and size, allowing them to mesh with each other such that each shaft turns the same number of rotations per minute. In this way, the shafts turn in opposite directions and the support cams and fly-knife cams will meet once during every rotation. A gear belt pulley 130 is mounted to shaft 108. A drive system (similar to the drive system from variator 24 of FIG. 1) provides the rotating power to this system.

Figure 5:
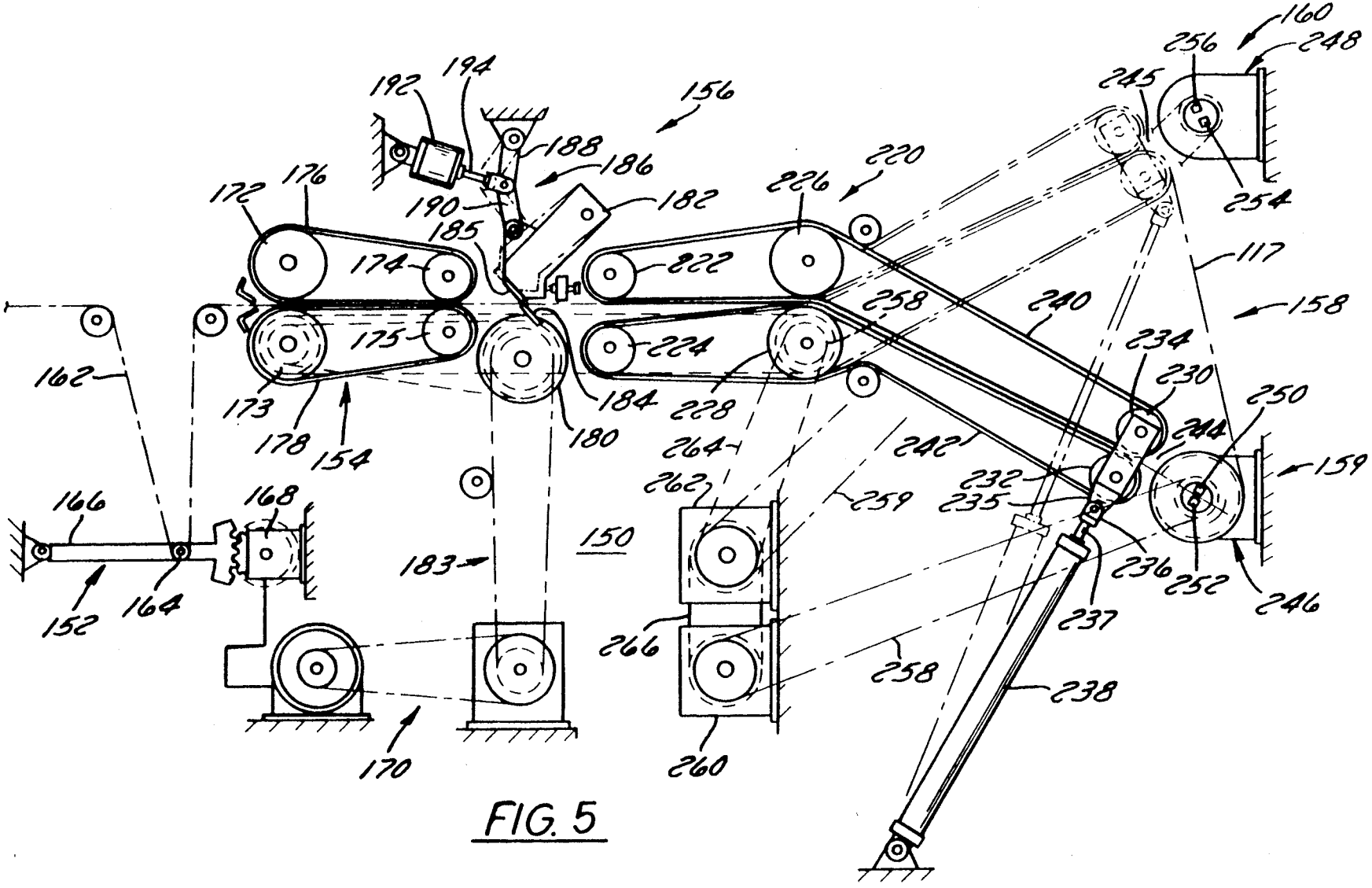
FIG. 5 is a side elevation schematic view of a coversheet winding machine with which the dampening system of the present invention may be employed.

With reference to FIG. 5, an alternative embodiment of the invention is depicted. In this embodiment a dampening system 200, similar to dampening system 100, is utilized in a coversheet winding machine 150, such as the coversheet winding machine illustrated in the '005 Gietman Jr. patent. In general, winding machine 150 includes: a dancer mechanism 152, a pull roll and feed section 154, a cutoff section 156, a conveyor system 158, and at least a pair of winding stations 159 and 160.

In operation a feed strip 162 of dropcloth material, formed of paper, plastic, cloth or other pliable material, enters machine 150 from an upstream supply, usually in the form of an unwind station or an extruder. For example, such materials may be prepared from plastic, such as polyethylene, which is melted in a bubble extruder to produce a continuous tube. The circumference of these tubes can be twelve feet or more. Prior to processing in machine 150, the tube is slit along its length to provide a continuous lay-flat strip, i.e. feed strip 162, having a width equivalent to the circumference of the bubble.

Feed strip 162 is typically folded, depending on the desired width of the final roll, by folding boards (not shown), which may be similar to folding boards of system 18 or others which are well known in the art.

Feed strip 162 enters dancer mechanism 152, which, as is known, slaves the speed of winding machine 150 to the speed of the film supply system. In particular, feed strip 162 passes around a roll 164 of a pivoting member 166, such that the tension of the strip causes movement of pivoting member 166. This tension is proportionate to the speed differential between the feeder and winder. A sensing device 168 senses the position of element 166 and continuously adjusts the speed of winding machine 150 through a drive system 170.

Film strip 162 then enters a pull roll and feed section 154, which includes four generally cylindrical rollers, a pair of larger pull rollers 172 and 173 disposed above one another at the entrance and a pair of smaller rollers 174 and 175 at the exit end. The pairs of rollers form nips. Upper rollers 172 and 174 are joined together by a plurality of spaced-apart ropes 176 which are located in annular grooves across the width of upper rollers 172 and 174. Bottom rollers 173 and 175 are connected by an endless belt 178. Film 162 conveyed through the nips and between the ropes and belt as it passes through pull roll and feed section 26.

In a preferred embodiment, pull rolls 172 and 173 have a circumference of about twelve inches so that for every revolution thereof, one foot of material is passed through pull roll and feed section 154. While the diameter of these rolls is not critical to the present invention, as known in the art, the use of rolls having a circumference equal to a convenient measurement, such as one foot or one meter, makes possible a more precise cut-along off of exact lengths of material for the final roll product.

After film strip 162 passes through pull roll and feed section 154 it enters cut-off section 156. As illustrated in FIG. 5, cut-off section 156 includes a rotating fly-knife 180 and a bed knife 182. Fly-knife 180 is rotated by drive system 183 connected to drive system 170. Fly-knife 180, like fly-knife 62 includes a fly-knife blade 184 embedded in its surface. Blade 184 differs from blade 68, however, in that blade 184 preferably extends across the entire surface of fly-knife 180. Similarly, bed knife 182 includes a bed knife blade 185.

Bed knife 182 is pivotally mounted for movement between the full line position shown in FIG. 5 to the dotted line position. When bed knife 182 is in the dotted line position, film strip 162 can pass through cutting section 156. Bed knife 182 preferably is moved from one position to the other through use of a collapsible link system 186. System 186 includes first and second elongate links 188 and 190 and least one pneumatic cylinder 192. Cylinder 192 and one end of link 188 are pivotally attached to the frame of machine 150. The other end of elongate link 188 is attached to a piston rod 194 of cylinder 192 and to one end of link 190. The other end of link 190 is pivotally attached to bed knife 182. The length of links 188 and 190 are selected such that when they are arranged linearly, bed knife 182 is in its cutting position. Action of cylinder 192 retracts rod 194 and causes links 188 and 190 to be angled with respect to each other, such that bed knife 182 is spaced apart from fly-knife 180.

In accordance with a preferred embodiment of the present invention, cylinder 192 is activated to move bed knife 182 into its cutting position by a counter system (not shown). One exemplary counter system includes a signal input device which receives a pulse signal with each revolution of pull roll 172, thus indicating the numbered feet of film passing through the nip between knives 180 and 182. A counter counts the impulses such that when the desired length of film has passed, cylinder 192 is activated causing bed knife 182 to move into its cutting position. In that position, strip 162 is scissored by action of fly-knife 180 against bed knife 182.

Figure 6:
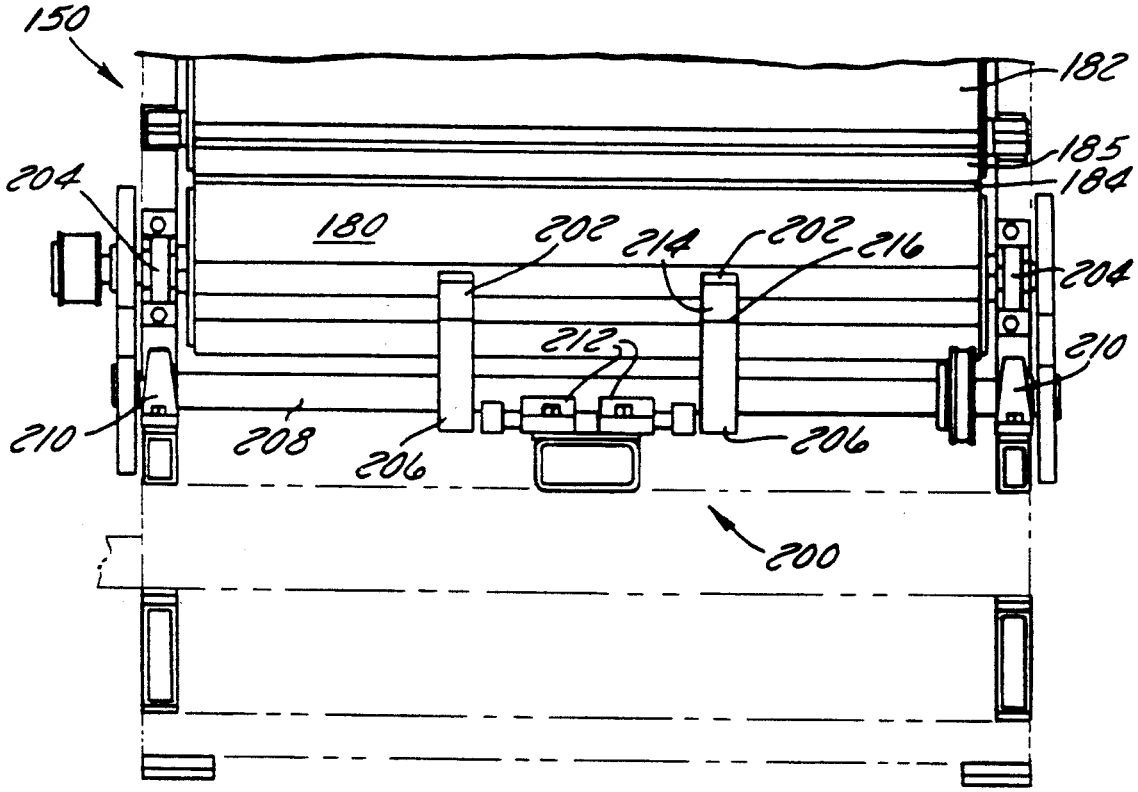
FIG. 6 is a front view showing the dampening system of the invention in a coversheet winding machine of FIG. 5.

Dampening system 200, like dampening system 100 with bag machine 10, ensures the accuracy of that cut. With reference to FIG. 6, showing a portion of winding machine 150, it can be seen that dampening system 200 includes a camming system that comes into play during that portion of the rotary cycle of fly-knife 180 when fly-knife 180 operatively engages bed knife 182. Preferably, dampening system 200 comprises respective fly-knife cams 202, respective fly-knife bearings 204, respective support cams 206, a support cam shaft 208, respective support cam shaft bearings 210.

In general, dampening system 200, like dampening system 100, is suitably arranged such that support cams 206 rotate with support cam shaft 208, fly-knife cams 202 rotate with fly-knife 180, and support cams 206 and fly-knife cams 202 meet and roll against each other as fly-knife blade 184 operationally engages bed knife blade 185 of bed knife 182.

In particular, according to a preferred embodiment of the present invention, fly-knife cams 202 are affixed to rotating fly-knife 180 opposite fly-knife blade 184. Each cam 202 includes a cam edge preferably comprising an arcuate edge. Similarly, support cams 206 are affixed to rotating support cam beam (shaft) 208. Support cam shaft bearings 210 are secured to the frame of winding machine 150. Support cams 206 are preferably keyed to shaft 208, and cams 206 rotate with shaft 208. Each cam 206 includes a cam edge preferably comprising an arcuate edge.

In a preferred embodiment of the invention, there are two fly-knife cams 202 and two support cams 206 which roll against each other. However, it should be appreciated that any number of fly-knife cams and support cams could be used, providing they provide adequate support for rotating fly-knife 180. Camming elements 202 and 206 are preferably coaxially mounted and spaced apart on fly-knife beam 180 and support cam beam 208, such that the camming surfaces 214 and 216 contact one another during that portion of the rotation of fly-knife 180, where fly-knife 180 performs its cutting operation against bed knife 182. Preferably, support cams 206 rotate counter-clockwise with support cam shaft 108 and fly-knife cams 202 rotate clockwise with fly-knife 180, the respective rotations being timed such that support cams 206 and fly-knife cams 202 meet and roll against each other as fly knife blade 184 passes bed knife blade 185. Rotating fly-knife 180 is thus supported and does not bow as the cut is made in film strip 162. A consistent quality cut is thus obtained.

Preferably, a drive system similar to that described in conjunction with dampening system 100 is utilized to ensure that fly-knife 180 and support cam beam 208 are rotating at the same speed. A drive system comprising an interconnected gear network, such as is known in the art, is suitable for this purpose.

Following strip cut off, a new leading edge of the folding plastic strip is created. That edge enters a conveyor system 220 having a first stationary portion and a second movable portion. The stationary portion comprises a pair of inlet rollers 222 and 224 near the exit of cut off section 156 and a pair of larger rollers 226 and 228 downstream of rollers 222 and 224. From FIG. 5, it can be seen that rollers 222 and 224 are spaced apart from one another to provide a space to receive the leading edge of the new strip of film, while rollers 226 and 228 are located above one another to provide a nip.

Downstream of rollers 226 and 228 are another pair of smaller rollers 230 and 232. Rollers 230 and 232 are rotatively mounted between a pair of rectangular plates 234. Plates 234 have a connecting member 235 located below roller 232. Member 235 includes a hole coupled to a clevis 236 secured to the external end of a piston rod 237 of a pneumatic cylinder 238. The opposite end of cylinder 238 is pivotally coupled to the winder frame. Nylon elastic ropes 240 are provided for the top set of rollers 222, 226 and 230. A continuous belt 242 connects lower rollers 224, 228 and 232.

It will be appreciated that extension of piston rod 237 causes the outlet of the movable conveyor section to be raised from a lower location 244 to an upper location 245, while at the same time conveyor system 220 remains fully operational and while sheet material is being conveyed therethrough.

Winder assemblies 246 and 248 are located respectively adjacent the outlets 244 and 245 of conveyor system 220. Assembly 248 includes a pair of elongate, spaced apart rods 250 and 252 and assembly 246 includes elongate, spaced apart rods 254 and 256.

Winding assemblies 246 and 248 are driven by belts 258 and 259, respectively, from a pair of magnetic particle clutches 260 and 262, which in turn are driven by a belt 264 coupled to a pulley (not shown) on clutch 262 and a pulley 258 on roller 228. Clutch 260 is driven by a belt 266 from clutch 260. Each of clutches 260 and 262 have a high and low torque circuit.

The operation of winder 150 can now be explained. When a first strip of material is fed through conveyor system 220, it will be directed to outlet 244 for winding on winding assembly 246. Winding will progress until the footage sensor determines that the preselected length of material has passed through the cut-off section 156. At that time, the two cylinders 192 and 238 will be activated to sever the film strip 162 and move the movable portion of conveyor system 220. At the time the cut is made, film will still be winding on winding assembly 246 and such winding will continue, even though the conveyor outlet has been moved to the position indicated by reference numeral 245. It should also be apparent that as the tail of the first strip is being wound on winding assembly 246, conveyor system 220 is positioned so that the leading edge of the next strip can be immediately introduced into winding assembly 248. The entire process would be reversed after the next severing step so that the third strip will be ready for attachment to winding assembly 246, as the winding of the second strip is finished on assembly 248, etc.

Those skilled in the art will understand that film is introduced into the gap between rods 250 and 252 or 254 and 256 when the rods are separated from one another the maximum distance designed into the system. After several inches of the film strip is passed through the opening between the rods (four to five inches in the preferred embodiment), the magnetic particle clutch coupled to the particular winder will engage in its high torque mode to begin the winding process. After the desired amount of material has been wound on the rods (keeping in mind that the conveyor system 220 has shifted before this time), a timing sequencer (not shown) stops the rotation of the shaft, preferably by means of an air brake. The roll of wound material is then removed by collapsing of the rods 250 and 252 or 254 and 256, and pushing off the wound rolls.

It will be understood that the above description is of a preferred exemplary embodiment of the invention, and that the invention is not limited to the specific form shown. For example, different numbers of cams may be used or different ways of timing the support cams and fly-knife cams may be implemented. Moreover, the precise configuration of the camming elements may be modified, for example, to have the shape of a circular plate with portions removed. Various other substitutions, modifications, changes and omissions may be made in the design and arrangement of the elements without departing from the scope of the invention as expressed in the appended claims.

What is claimed is:

1. A fly-knife dampening system, comprising:

an elongate bed knife which is stationary during use of the system and having a bed knife blade;

an elongate rotating fly-knife having a fly-knife blade and plural and spaced apart cams disposed thereon, said fly-knife being rotatable about an axis such that at a predetermined time during such rotation, said fly-knife blade operatively engages said bed knife blade; and a rotating support shaft parallel to, but spaced apart from said rotating fly-knife, said support shaft having plural and spaced apart support cams mounted thereon for rotation therewith, said support cams disposed such that each time said fly-knife blade operatively engages said bed knife blade, said support cams engage said fly-knife cams.

2. The fly-knife dampening system of claim 1, wherein said fly-knife cams have an arcuate edge, and said support cams have an arcuate edge, said arcuate edges of said fly-knife cams being designed to roll against said arcuate edges of said support cams.

3. The fly-knife dampening system of claim 2, further comprising means for controlling the rotation of said support shaft and said rotating fly-knife such that said support cams and said fly-knife cams rotate at the same speed.

4. The fly-knife dampening system of claim 2, wherein two support cams contact two fly-knife cams.

5. A system for use in machine for making bags from a polymeric film, said system comprising:

an elongate bed knife having a bed knife blade, said bed knife being stationary during use of the system;

an elongate rotating fly-knife having a fly-knife blade and plural and spaced apart fly-knife cams disposed thereon, said fly-knife blade being operatively engageable with said bed knife to perform operations on the film;

an elongate rotating support shaft having plural and spaced apart support cams mounted thereon, said support cams disposed such that contact is made between said support cams and fly-knife cams each time said fly-knife blade operatively engages said bed knife; and wherein said bed knife is mounted for rotational movement away from said fly-knife, whereby the film can pass through the juncture of said fly-knife and said bed knife without having operations performed thereon when the system is not in use.

6. In a machine for making plastic bags from plastic film moving along a film path of the type comprising a drum-shaped rotatable sealing means for sealing said film, blanket means surrounding a portion of said sealing means and rotatably driving said sealing means, folding means located along said path, and knife means along said path for selectively cutting and perforating said film to form interconnected bags, the improvement wherein:

said knife means comprises:

an elongate bed knife which is stationary during use of the system and including a bed knife blade;

an elongate rotating fly-knife including a fly-knife blade rotatable about a longitudinal axis and having plural and spaced apart cams disposed thereon, said fly-knife blade being operatively engagable with said bed knife blade at a predetermined time during rotation of the fly-knife; and a rotating support shaft parallel to, but spaced apart from said rotating fly-knife, said support shaft having plural and spaced apart support cams mounted thereon for rotation therewith, said support cams disposed such that each time said fly-knife blade operatively engages said bed-knife blade, said support cams engage said fly-knife cams.

7. The machine of claim 6, further comprises:

a drive system for operatively driving said fly-knife and said support shaft such that said support cams operatively contacts said fly-knife cams as said fly-knife blade operatively engages said bed knife blade.

8. The machine of claim 7, wherein said fly-knife cams have an arcuate edge.

9. The machine of claim 7, wherein support cam has an arcuate edge.

10. The machine of claim 7, wherein two support cams contact two fly-knife cams.

11. A system for use in a winder for winding elongate strips of pliable material, such as plastic film, cloth or paper, into coreless rolls, said system comprising:

an elongate bed knife which is stationary during use of the system having a bed knife blade;

an elongate rotating fly-knife having a fly-knife blade and plural and spaces apart cams disposed thereon, said fly-knife blade being operatively engagable with said bed knife blade to sever said pliable material;

a rotating support shaft parallel to, but spaced apart from said rotating fly-knife, said support shaft having plural and spaced apart cams mounted thereon for rotation therewith;

wherein said support cams are disposed such that contact is made between said support cams and said fly-knife cams when said fly-knife blade operatively engages said bed knife blade to sever said pliable material.

12. The system of claim 11, wherein said bed knife is movable into a cutting position in which said fly-knife is operatively engagable with said bed knife and said support cams are operatively engagable with said fly-knife cams.

13. The system of claim 12, further comprising drive means for operatively driving said fly-knife cams and said support cams such that said support cams and said fly-knife cams rotate at substantially the same speed.

* * * * *